US006588684B1

(12) United States Patent
Staples et al.

(10) Patent No.: US 6,588,684 B1
(45) Date of Patent: Jul. 8, 2003

(54) FLUID INJECTOR FOR TANK CLEANING

(76) Inventors: Wesley A Staples, Rte. 3, Box 1512, Palatka, FL (US) 32177; Russell E. Staples, Rte. 5, Box 8082, Palatka, FL (US) 32177

( * ) Notice: Subject to any disclaimer, the term of this patent is extended or adjusted under 35 U.S.C. 154(b) by 0 days.

(21) Appl. No.: 09/412,396

(22) Filed: Oct. 5, 1999

Related U.S. Application Data

(60) Provisional application No. 60/112,946, filed on Dec. 18, 1998.

(51) Int. Cl.[7] ..... A62C 31/02; B08B 3/00

(52) U.S. Cl. ..... 239/548; 239/DIG. 13; 239/390; 134/167 R

(58) Field of Search ..... 239/227, 390, 239/391, DIG. 13; 134/10, 34, 104.2, 172, 167 R; 15/104.069

(56) References Cited

U.S. PATENT DOCUMENTS 4,827,680 A * 5/1989 Rushing et al. ..... 239/419.3
5,108,035 A * 4/1992 Friedrichs ..... 239/227
5,217,166 A * 6/1993 Schulze ..... 239/227
5,452,853 A * 9/1995 Shook et al. ..... 239/227
5,454,517 A * 10/1995 Naemura ..... 239/390
5,465,777 A * 11/1995 Brunner ..... 164/136

* cited by examiner

*Primary Examiner*—David A. Scherbel
*Assistant Examiner*—Davis Hwu
(74) *Attorney, Agent, or Firm*—Miles & Stockbridge P.C.; John C. Kerins

(57) ABSTRACT

A fluid injector system for use in tank cleaning is provided, the injector system including an injector head block housing two disc-shaped injectors which may be rotated inside of the injector head block to change the orientation of bores extending through the disc-shaped injectors, which discharge pressurized fluid therethrough. The injector head block depends downwardly from a housing, and is rotatable relative to the housing by rotating a drive tube assembly housed partially within the housing and connected to the injector head block. The disc-shaped injectors are rotated by a vertical movement of the injector head block by virtue of a linkage assembly linking the injectors to a portion of the structure that is vertically stationary when the injector head block is moved vertically.

20 Claims, 4 Drawing Sheets

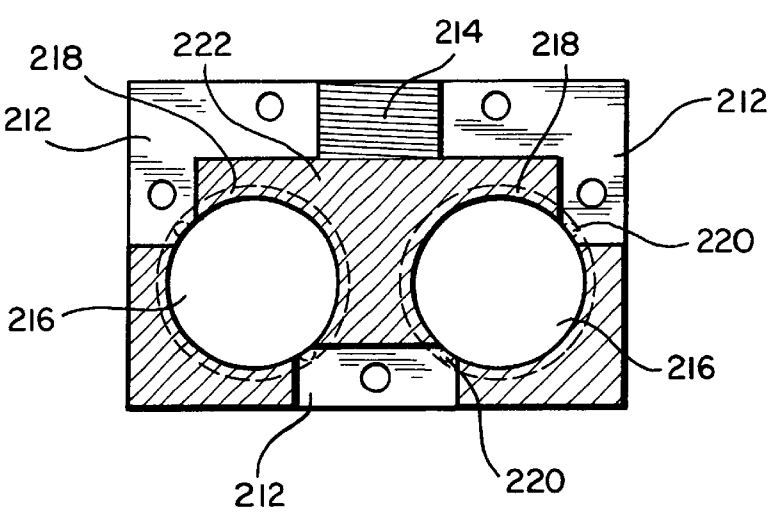
FIG. 4
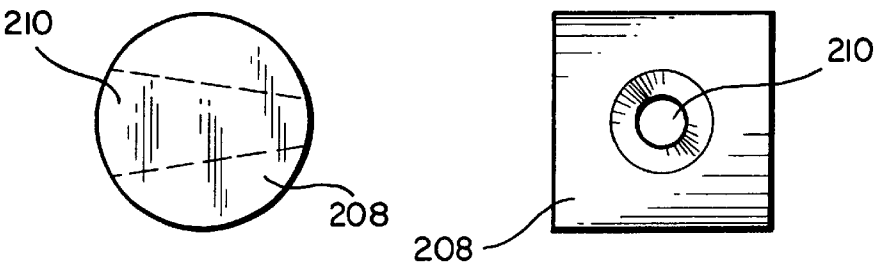
FIG. 5
FIG. 6
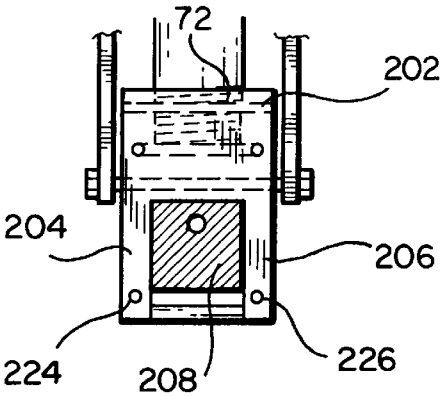
FIG. 3
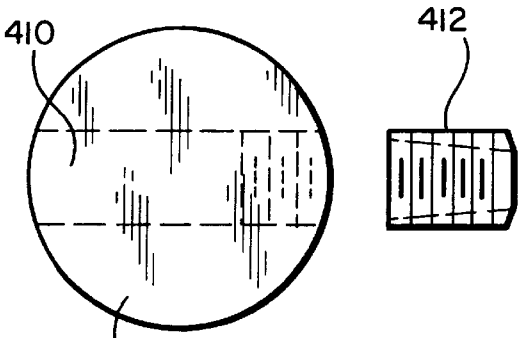
FIG. 8

FLUID INJECTOR FOR TANK CLEANING

This application is directed to an invention that has been described and depicted in U.S. Provisional Application Ser. No. 60/112,946, filed Dec. 18, 1998.

BACKGROUND OF THE INVENTION

The present invention relates to a fluid injector system for use in cleaning industrial tanks.

Material handling units, such as holding tanks or the like, are used in a wide range of industries, such as the pulp and paper industries, chemical industries, mining and refining industries, and the steel industry. One problem that exists in connection with the use of such holding tanks is that, over time, the liquid in the holding tank can no longer hold the solids suspended therein in solution, and the solids fall out, or are precipitated, and load the bottom of the tank. The settled solids reduce tank capacity, can clog pumps, and, in some instances, lock in valuable capital costs of material.

In order to avoid excessive solids buildup, such industrial tanks must periodically be cleaned. Various tank cleaning methods and devices have heretofore been proposed for use. One such apparatus is disclosed in U.S. Pat. No. 5,253,812. Other techniques have also been used.

Pressure washing of industrial tanks to remove settled sludge from the bottom of the tank has been performed in the past. However, known pressure washing systems have required that the tank be taken offline, or out of service, and drained, in order to expose the sludge for spraying and removal by pressurized fluid. This results in expensive downtime for the tank, presents the problem of where to temporarily store the liquid in the tank (if it has economic value), and presents other scheduling and logistics problems.

The problem to be solved is thus to provide a tank cleaning system that can be used to clean sludge out of the tank without the need to take the tank out of service and/or drain the existing liquid from the tank.

SUMMARY OF THE INVENTION

The present invention is directed to an injector system capable of injecting pressurized fluid into a sludge layer settled in a tank, to break up the sludge into pieces small enough to be pumped out of the tank by a slurry pump or to be removed by other removal equipment. The injector system is capable of being used even when liquid is present in the tank above the surface of the sludge The injector system includes a housing having an injector head disposed at a lower side thereof, and the housing has a fluid feed tube extending therethrough which supplies a fluid to the injector head from a fluid supply source. The injector head is capable of being rotated through 360° in a horizontal plane, and has two injectors retained therein which can each be rotated through approximately 90°, from pointing in a substantially horizontal orientation, wherein the injectors oppose each other, to pointing in a substantially vertical downward orientation.

The housing of the injector system houses a hydraulic system or subsystem including a hydraulic motor and hydraulic cylinder, that powers the rotation of the injector head and the injectors through various mechanical couplings. The housing may be in either a "stand up" (vertical orientation) or a "lay down" (horizontal orientation) configuration. The injector system is preferably positioned and maneuvered around in the tank by a wire based guidance system of the type disclosed in U.S. Pat. No. 5,526,989.

The injector system is designed to deliver pressurized liquid through the nozzles directed at the sludge layer, to break up the sludge into pieces of a size such that the sludge can be removed by a separate slurry pump or other removal equipment. The pressurized liquid may be water or the liquid present in the tank above the settled sludge, or a combination of the two. Alternatively, a liquid which is soluble with the contents of the tank, may be employed. As an illustrative example, diesel fuel may be used in cleaning an oil tank.

BRIEF DESCRIPTION OF THE DRAWINGS

These and other features of the present invention and the attendant advantages will be readily apparent to those having ordinary skill in the art and the invention will be more easily understood from the following detailed description of the preferred embodiment taken in conjunction with the accompanying drawings wherein like reference characters represent like parts throughout the several views.

FIG. 3 is a side elevation view of the injector head of the injector system illustrated in FIG. 1.

FIG. 4 is a front elevation view of one-half of the injector head.

FIG. 5 is a front elevation view of an injector according to a preferred embodiment of the present invention.

FIG. 6 is a side elevation view of an injector according to a preferred embodiment of the present invention.

FIG. 8 is a front elevation view of an alternative preferred embodiment of an injector.

DETAILED DESCRIPTION OF THE PREFERRED EMBODIMENT

Figure 1:
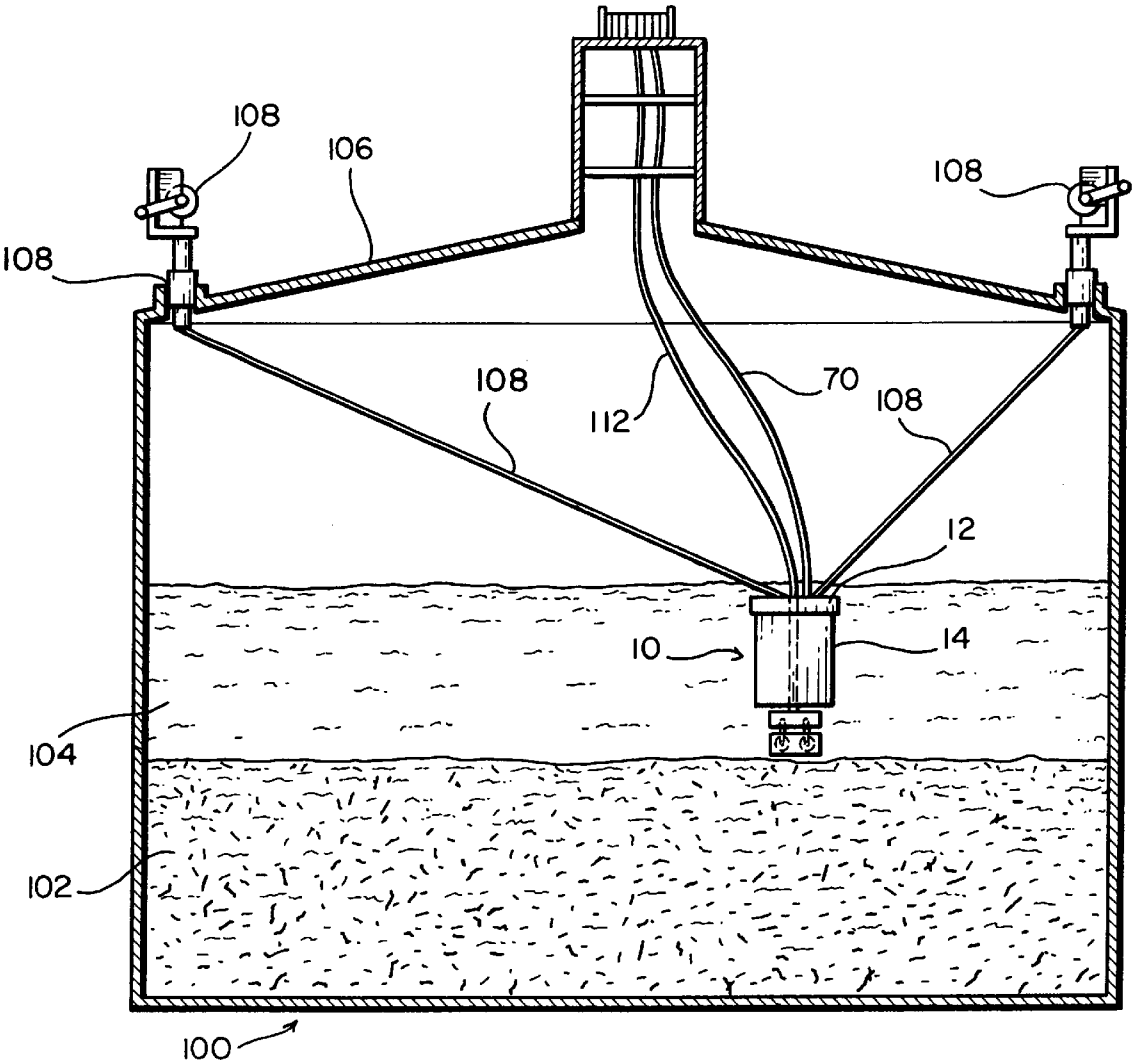
FIG. 1 is a cutaway view of a tank illustrating the injector system of the present invention in substantially schematic form.

Referring initially to FIG. 1, a tank 100 is illustrated in a cutaway, or a substantially schematic cross-section. A layer of settled solids or sludge 102 is shown in the bottom of the tank, and, as is typical, the liquid 104 stored in the tank occupies the space above the sludge. The injector system 10 of the present invention is illustrated in schematic form as being suspended from the roof 106 of the tank 100 by a guidance system 108 using wire, cable or chain, or other suitable material.

The guidance system, termed a positive guidance system 108, is fully disclosed in U.S. Pat. No. 5,526,989, the disclosure of which is hereby expressly incorporated by reference. The injector can be moved around in the tank 100, and may be maintained at the desired level, namely riding on the top of the layer of sludge or hovering in close proximity to the top of the sludge, by the positive guidance system. The positive guidance system has the advantage of not requiring a worker to be inside the tank while the tank is being cleaned, and the positive guidance system can be installed without the necessity of emptying the liquid out of the tank. As also noted in the referenced patent, the guidance system also provides the ability to connect the cleaning device, here, the injector system, to the guidance system outside of the tank, and to lower the cleaning device into the tank through a manway or other opening in the roof, to the desired position and height.

The injector system 10 has a sling strap 12 secured at an upper portion of the system housing 14, with the sling strap 12 connecting to fasteners 110 on the cables of the positive guidance system. The sling strap operates in conjunction with the cables to retain the injector system in a substantially upright or vertical orientation, to the extent practicable.

Figure 2:
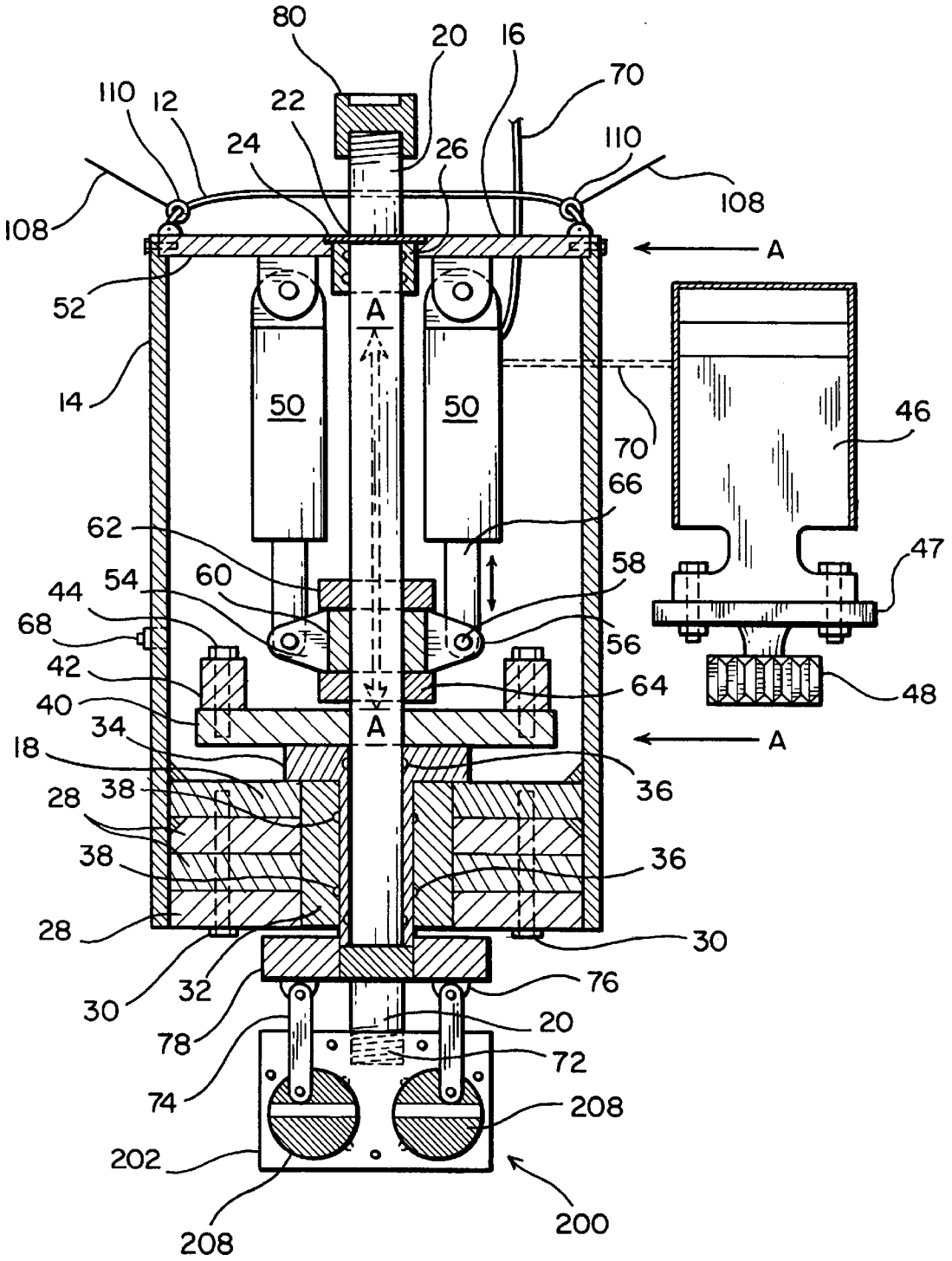
FIG. 2 is a cross-sectional view of a preferred embodiment of the injector system of the present invention.

Turning now to FIG. 2, the injector system according to a preferred embodiment is shown in greater detail in the cross-sectional view of that drawing figure. The housing 14 of the injector system may preferably be a length of 12 inch diameter pipe, or a fabricated steel box, or similar housing structure. The housing has a top plate 16 and a bottom plate 18 closing off the upper and lower ends of the housing.

A fluid feed tube 20, which may preferably be a small diameter pipe capable of withstanding high pressure, extends through an opening 22 in the center of the housing. The fluid feed tube has a fluid tight seal 24, which seals off the interior of the housing from the external environment.

The fluid feed tube is not rigidly fixed to the housing, but rather may be rotated about the longitudinal axis of the tube and may be moved upwardly and downwardly relative to the housing, along its axial direction. A top bearing 26 disposed in the opening under the seal is secured to the top plate 16 of the housing to facilitate such relative movement.

Bottom plate 18 is affixed at or near the lower extent of the housing 14, and may preferably be welded in place. Where desired to increase the stability of the housing in an upright position, space is provided underneath bottom plate 18 in the housing for placement of additional weight plates 28, which may be retained in place by bolts 30 threaded into tapped bores in the bottom plate.

A lower bearing assembly 32 is secured to bottom plate 18 at a central opening in the bottom plate. The additional weight plates 28 have an opening sized to closely surround the outer surface of bearing 32. Fluid feed tube 20 protrudes downwardly through the inner opening in the bearing 32, and is threaded onto injector head block 202 of injector head assembly 200, the details of which will be discussed later in this specification.

Surrounding the fluid feed tube 20 at the region where the tube exits the housing 14, is a rotary drive tube 34 that forms a fluid-tight seal with the bearing 32 through O-rings 36, and forms a fluid-tight seal against the outer surface of fluid feed tube 20 through the use of O-rings 38. Rotary drive tube 34 is secured inside housing 14 to a ring gear drive plate 40, which has a ring gear 42 fastened thereto by bolts 44. A hydraulic motor 46, shown outside housing 14 for the sake of clarity, is mounted to an interior wall of housing 14 by way of mounting bracket 47 in the final assembled unit, and has a drive gear 48 which engages and drives ring gear 42 as desired.

Housing 14 also contains one or more (two shown) two-way hydraulic cylinders 50, which are preferably secured to the inner surface 52 of top plate 16. The cylinders are linked to the outwardly extending ears 54 of a trunnion assembly 56 by pins 58. The trunnion assembly has a bearing assembly 60 at its inner extent, to facilitate relative rotational movement of the fluid feed tube 20. The trunnion assembly is retained in a fixed axial position relative to the fluid feed tube 20 by upper and lower stop collars 62, 64, respectively. As will be discussed in more detail in the discussion of the operation of the injector head and injectors, the piston arms 66 of the hydraulic cylinders may be made to travel upwardly and downwardly through a predetermined range of travel, thereby raising and lowering fluid feed tube 20 along its axial direction.

Housing 14 further has an oil plug 68 threaded into an opening in the side wall of the housing at a position above the gearing, as it is preferred that the lower portion of the housing be filled with oil to lubricate at least the lower internal parts contained in the housing. Housing 14 is further shown as having a hydraulic line 70 extending through the upper plate 16, and connected to the hydraulic motor and hydraulic cylinders. Hydraulic power for operating the motor and hydraulic cylinders is provided by a hydraulic power system (not shown) that is preferably to be disposed outside the tank. FIG. 1 shows the hydraulic line entering the tank, and extending down to the injector system 10.

The injector head assembly 200 of injector system 10 according to a preferred embodiment of the present invention is illustrated in FIGS. 2–6. Injector head block 202 is preferably formed of two half-blocks 204, 206 that are bolted together in the final assembly. The injector head block 202 houses one or more (two shown) injectors 208, preferably made of thick (approximately 1–2½ inch) steel discs, as best seen in FIGS. 5 and 6. The injectors preferably each have a tapered, essentially frustoconical, bore 210 extending through the center thereof, having an orientation defined by a central axis about which the bore is symmetrical, with the central axis preferably extending along a diameter of the disc.

While a tapered bore appears to be preferred for most expected uses, an alternative preferred embodiment, as shown in FIG. 8, employs a substantially cylindrical bore 410 which is tapped (i.e., provided with female threading) at one end of the bore. The injector 408 in this embodiment will receive an injector tip 412 having male threads for threadingly engaging the tapped end of bore 410. Injector tips 412 of varying sizes, shapes, or degrees of internal taper may thus be provided with the unit. The tips may be changed as necessary to have specific tip configurations used for specific types of cleaning jobs.

Referring to FIG. 4 especially, the manner in which the injectors are retained in the injector head block 202 will be discussed. Each of the half-blocks 204, 206 are preferably machined, or possibly cast, having mating surfaces 212 at the upper corners and along a portion of the lower edge of the half-blocks. A threaded connection region 214 is formed between the upper corner mating surfaces, although this may preferably be formed by tapping a rough-cut opening after the two half-blocks are assembled into the block. Openings 216 are machined to the same diameter as the diameter of injector discs 208.

The portion of the half-block that does not form part of the mating surfaces 212 nor the threaded connection region 214, and that is not fully removed in creating openings 216, is machined down to approximately one-half of the original block thickness, or by a somewhat greater amount (see, e.g., FIG. 3). O-ring grooves 218, 220 are formed in the half-blocks as well, in order to provide a fluid-tight seal between the injector discs 208 and the injector head block 202. The O-ring grooves may alternatively be placed in the injector disc 208. It can be seen in FIG. 4 especially that the area 222 in head block 202 will receive the pressurized fluid from fluid feed tube 20, and distribute the fluid to the two injectors 208.

The injector head block is assembled by placing O-rings 224, 226, or other suitable seals, in grooves 218, 220, in each half-block, positioning the injectors 208 in alignment with their respective openings on each half-block, and then bolting together the two half-blocks to form the injector head block 202. The assembled head block 202 is threaded onto the lower threaded end 72 of the fluid feed tube 20. Final connections of the injector head block 202 to the injector assembly 10 are made by securing pivotable link arms 74 to the injectors 208 and to anchors 76 extending downwardly from a drive plate 78, which itself is threaded onto the lower end of rotary drive tube 34.

Thus, as the ring gear drive plate 40 is rotatingly driven by the hydraulic motor 46 and ring gear 42, rotary drive tube and drive plate 34 and 78, respectively, rotate the entire injector head through a full 360° sweep in a horizontal plane. It should be noted that, as used herein, the term "horizontal" is used as shorthand to describe the orientation of the injector head and drive plate, or an orientation perpendicular to the axis of rotation. If the injector system is tilted in operation, the rotation will obviously not be in a true horizontal plane, but will be in a plane described herein as horizontal. Drive plate 78 is preferably provided with a left-hand thread for its connection to drive tube 34, whereas vertical fluid shaft 20 is provided with a right-hand thread. This results in a self-tightening connection once all components are assembled, and the connection prevents either threaded unit from coming loose.

This rotation of the injector head in turn causes fluid feed tube to rotate within the housing 14, and accordingly, along its entire extent. A rotary swivel connector, shown schematically by reference numeral 80 in FIG. 2, may preferably be provided at an upper extent of fluid feed tube 20, to connect the fluid feed tube to a fluid feed line 112 (FIG. 1), such that the rotary movement is taken up in the connector.

It is presently contemplated that the injector system will be controlled such that the hydraulic motor runs constantly while the unit is in operation, such that the horizontal rotation of the injector head 200 is constant. The orientation of the injector bores may, in addition, be adjusted through preferably nearly 90°, or from pointing essentially along an axis parallel to the fluid feed tube 20, to pointing along an axis substantially perpendicular to the axis of the fluid feed tube. This is accomplished by the construction and linkages discussed above with respect to, especially, FIGS. 2 and 3.

When it is desired to adjust the orientation of the injector bores, the hydraulic cylinders 50 are adjusted to extend or retract the piston arms 66, as appropriate, which in turn moves trunnion assembly 56 and fluid feed tube 20 upwardly (pistons retracting) or downwardly (pistons extending) relative to housing 14. Fluid feed tube accordingly moves within the drive tube 34 and pulls (when moving upwardly) or pushes (when moving downwardly) on injector head block 202. This causes the block to move in response to the force, and causes injectors to rotate about their pivotable linkages, thereby changing the orientation of the bores 210 extending through the injectors.

Figure 7:
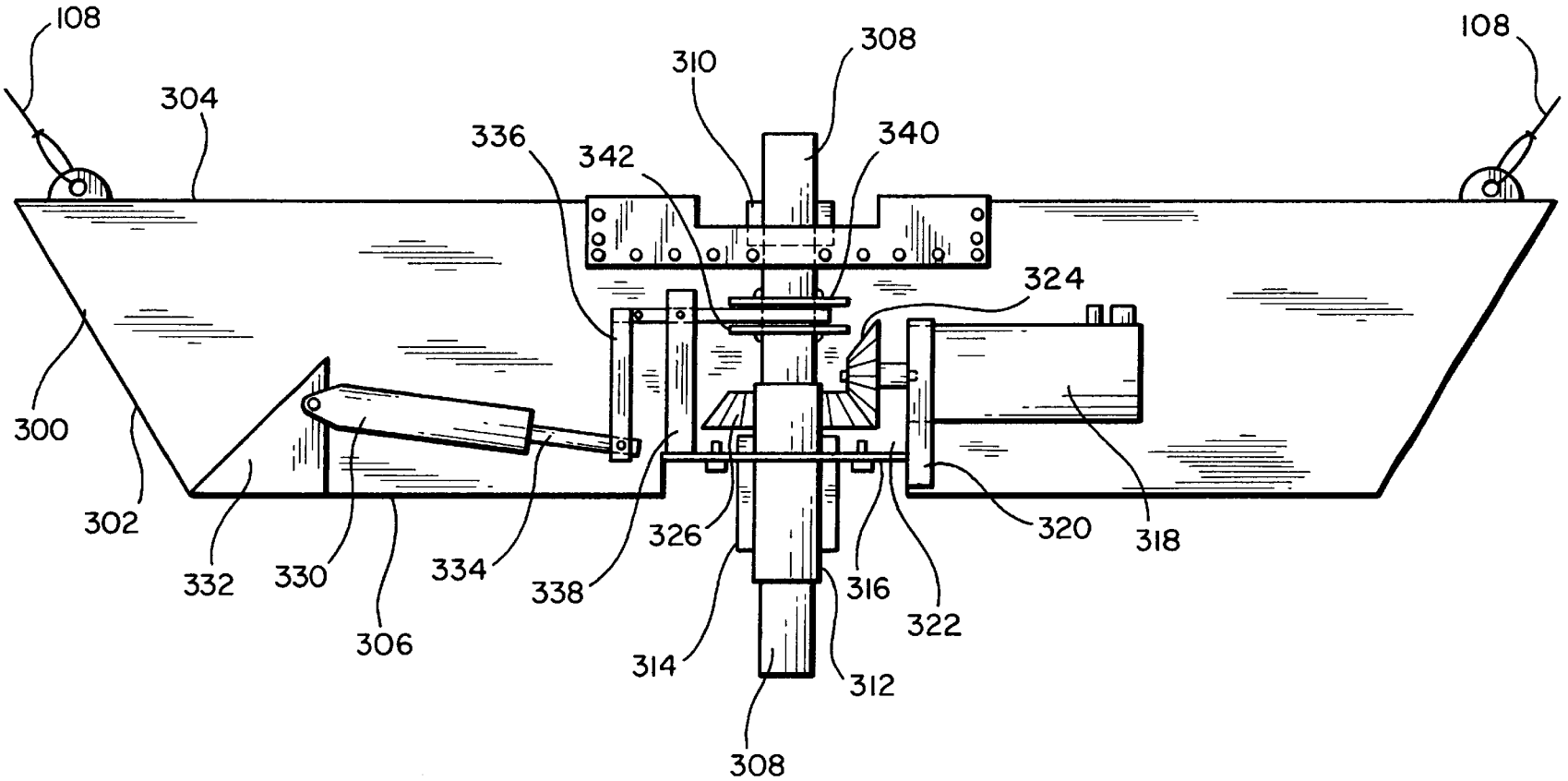
FIG. 7 is a cross-sectional view of an alternative preferred embodiment of the injector system of the present invention.

In the alternative preferred embodiment illustrated in FIG. 7, the injector head assembly (not shown in FIG. 7, numeral 200 in FIG. 2) is preferably identical to that shown in FIGS. 2–6. In the FIG. 7 embodiment, housing 300 is of a flatter, more horizontal, configuration. This embodiment may perform better is some circumstances that the previously discussed embodiment, such as, for example, where the consistency of the sludge to be broken up makes it difficult to maintain the more vertically oriented embodiment of FIG. 2 in its upright orientation.

Housing 300 is preferably of a short inverted frustoconical or inverted truncated square pyramid shape, having a side wall 302 and a top and bottom plate 304, 306, respectively. Fluid feed tube 308 extends through the housing, as in the previous embodiment, having a fluid-tight engagement with top bearing assembly 310, which facilitates both rotational and axial movement relative to the housing. Fluid feed tube 308 extends outwardly through the lower end of the housing though the interior of rotary drive tube 312. A lower bearing assembly 314 surrounds the rotary drive tube 312 and is secured to a section of plate 316 that is connected in fluid-tight engagement to the bottom plate 306 of the housing.

The desired rotary motion of the injector head (200, FIG. 2) secured to the lower end of fluid feed tube 308 is accomplished by a hydraulic motor 318 mounted horizontally within housing 300 by a motor mount bracket 320 secured to the housing 300. The hydraulic motor drives a beveled drive gear 324 of a bevel gear pair 322, and driven gear 326 of the gear pair is secured to the upper end of rotary drive tube 312. Thus, the motor drives the gear pair, which converts the horizontal rotary motion to vertical rotary motion, and the gear pair drives the rotary drive tube, which, as in the previous embodiment, is coupled to the lower drive plate which is linked to the injector head (see FIG. 2).

The adjustment of the injectors to orient the injector bores as desired is accomplished in the FIG. 7 embodiment by a linkage assembly that includes a horizontally oriented two-way hydraulic cylinder 330 pivotably anchored to a cylinder brace 332, which itself is secured to an inner wall of the housing 300. The piston arm 334 of the cylinder is pivotably connected to an L-shaped arm 336, which itself is pivotably secured to a lever bracket 338 connected to and extending upwardly from the bottom plate of the housing.

At a distal, or far, end of the L-shaped arm 336, the arm is retained between upper and lower stop collars 340, 342, respectively, with the collars being secured to the fluid supply tube. The L-shaped arm 336 is either forked at its distal end to straddle the fluid supply tube, while still permitting rotation thereof, or a cam follower bracket may be employed. Details of this arrangement are not illustrated, as such connections are well understood in the art.

The fluid supply tube is thus raised or lowered, to bring about the desired reorientation of the injector bores, by controlling the hydraulic cylinder to retract or extend the piston arm, which in turn forces the L-shaped arm pivoting about the pinned connection at lever bracket 338, to either raise or lower the fluid supply tube. Because the injector head and its connection to the fluid supply tube and drive plate are to be identical to that shown in FIG. 2, the action of raising and lowering the fluid supply tube relative to the housing will operate in the same manner to reorient the injector bores.

Thus, by positioning the hydraulic motor and the hydraulic cylinder in a horizontal orientation, the housing 300 can be made to have a shorter profile, which, as noted above, can provide improved operation in certain tank cleaning environments.

By providing a liquid-tight housing containing all parts that might be sensitive to the external environment, the injector assembly of the present invention can be used in a submerged or semi-submerged position relative to liquid contained in a tank to be cleaned. Further, by providing a fluid injector arrangement that has injectors introducing pressurized cleaning fluid though a continuous 360° sweep, and at an orientation relative to the surface of the sludge selected and adjusted to be optimized for the specific conditions found in the tank, a highly efficient approach to breaking up sludge and achieving the optimum fluidization of the material to be cleaned from the tanks is obtained.

The injector assembly may operate to inject liquid at pressures typically in the range of 400–500 psi, at fluid flow rates of about 300–600 gallons per minute. The injector assembly should further be suitable for use at much higher pressures, such as 20,000 psi, if the particular cleaning operation requires the use of higher pressures.

The fluid supply may be an external source of water supplied at 600 psi through fluid supply line 112, which may be a 2" hose pressure rated at 800 psi. While this reflects the current pressure levels employed, the fluid injector is expected to be capable of handling operating pressures of 20,000 psi and higher, and the hose used for such applications may preferably be rated at 32,000 psi. The fluid may be pressurized by using a pumping unit equipped with a diesel engine located outside the tank, preferably at the base of the tank. The pump may be set up to use only water, or to use fluid retrieved from, and recirculated to, the tank, or a combination of the two fluids. This is generally determined by the needs of the tank operator, in terms of, for example, the need for higher or lower solids content in the slurry formed by the injector system.

The slurry produced from the sludge and other material broken up by the injector system is generally removed from the tank by a separate system, such as a hydraulically driven slurry pump.

It is also possible to employ more than two injectors on the injector assembly, if desired, although, with the 360° rotation, the additional cost and complexity may not be warranted. Three, four or even more injectors may be disposed in the injector head assembly, preferably being oriented at evenly spaced increments around said injector head. It is further possible to provide two or more injector head assemblies depending downwardly from the housing of the injector system.

It is to be recognized that the foregoing preferred embodiments are depicted and described for illustrative purposes, and the invention is not to be limited only to such embodiments. Various modifications and changes may become apparent to those of ordinary skill in the art upon studying this disclosure, and such modifications and changes do not depart from the spirit and scope of the invention. Accordingly, the scope of the invention herein is to be determined by reference to the appended claims.

What is claimed is:

1. A fluid injector system comprising an injector head assembly, said injector head assembly comprising an injector head block retaining at least one injector, each of said one or more injectors having a bore extending therethrough to permit a flow of pressurized fluid therethrough, said at least one injector being housed in said injector head block such that said at least one injector are rotatable relative to said injector head block, said fluid injector system further comprising at least two injectors, and having means for orienting said at least two injectors such that an outlet end of each of said injectors is positioned to discharge liquid in a different direction from, or along a different axis from, the other of the at least two injectors.

2. A fluid injector system as recited in claim 1, wherein said bore extending through each of said at least two injectors is a tapered bore.

3. A fluid injector system as recited in claim 2, wherein said bore extending through each of said at least two injectors is a substantially cylindrical bore.

4. A fluid injector system as recited in claim 3, wherein an outlet end of each of said bores is tapped with female threading.

5. A fluid injector system as recited in claim 4, further comprising at least two injector tips adapted to threadingly engage each of said tapped outlet ends of each of said bores.

6. A fluid injector system as recited in claim 5 further comprising a plurality of sets of injector tips, wherein each set of injector tips has a different configuration, and wherein each of said sets of injector tips is interchangeable with each other set, in being threadingly engageable with said bores of said injectors.

7. A fluid injector system comprising:

a housing having an injector head assembly positioned at an underside of said housing, said injector head assembly having means for discharging pressurized fluid through at least one injector to an external environment, a fluid feed tube extending through said housing, from a position above said housing to a position below said housing; said fluid feed tube being fluidly coupled to said injector head assembly at a lower end of said fluid feed tube, whereby said fluid feed tube is operable to supply pressurized fluid to said injector head assembly;

said housing having disposed therein a drive means surrounding said fluid feed tube for rotating said injector head assembly relative to said housing, and about an axis of said fluid feed tube, said drive means having a drive tube assembly extending from within said housing to an exterior of said housing, and surrounding said fluid feed tube, said drive tube assembly further being coupled to said injector head assembly, and means for moving said pressurized fluid discharging means such that said at least one injector is moved to discharge fluid at a plurality of angles relative to an axis of rotation of said injector head assembly.

8. A fluid injector system as recited in claim 7, wherein said housing further has, disposed in an interior thereof, a means for moving said fluid feed tube upwardly and downwardly in an axial direction relative to said housing, and relative to said drive tube assembly.

9. A fluid injector system as recited in claim 8, wherein said fluid feed tube moving means comprises at least one hydraulic cylinder.

10. A fluid injector system as recited in claim 7, wherein said drive means for rotating said injector head assembly comprises a hydraulic motor coupled to said drive tube assembly by gear means.

11. A fluid injector system as recited in claim 10, wherein said drive tube assembly comprises a drive tube surrounding said fluid feed tube and extending from an interior of said housing to an exterior of said housing, and a drive plate fixed to said drive tube, and wherein said injector head assembly is coupled to said drive plate by a linkage assembly which permits the injector head assembly to move toward and away from said drive plate.

12. A fluid injector system as recited in claim 11, wherein said injector head assembly comprises an injector head block retaining at least two injectors, said injectors having bores extending therethrough to permit the flow of pressurized fluid therethrough, said injectors being housed in said injector head block such that said injectors are rotatable relative to said injector head block, and wherein said injectors are pivotably linked to said drive tube assembly whereby, upon axial movement of said fluid feed tube by said means for moving said fluid feed tube, said injectors are rotated relative to said injector head block.

13. A fluid injector system as recited in claim 12, wherein said at least two injectors are disc-shaped, and are housed in complementary shaped recesses in said injector head block.

14. A fluid injector system as recited in claim 8, wherein said injector head assembly comprises an injector head block retaining at least two injectors, said injectors having bores extending therethrough to permit the flow of pressurized fluid therethrough, said injectors being housed in said injector head block such that said injectors are rotatable relative to said injector head block, and wherein said injectors are pivotably linked to said drive tube assembly whereby, upon axial movement of said fluid feed tube by said means for moving said fluid feed tube, said injectors are rotated relative to said injector head block.

15. A fluid injector system as recited in claim 14, wherein said at least two injectors are disc-shaped, and are housed in complementary shaped recesses in said injector head block.

16. A fluid injector system as recited in claim 7, wherein said injector head assembly comprises an injector head block retaining at least two injectors, each of said at least two injectors having a bore extending therethrough to permit the flow of pressurized fluid therethorough, said injectors being housed in said injector head block such that said injectors are rotatable relative to said injector head block, and means for orienting said injectors such that an outlet end of each of said injectors is positioned to discharge liquid in a different direction from, or along a different axis from, the other of the said at least two injectors.

17. A fluid injector system as recited in claim 16, wherein said bore extending through each of said at least two injectors is a tapered bore.

18. A fluid injector system as recited in claim 16, wherein said bore extending through each of said at least two injectors is a substantially cylindrical bore.

19. A fluid injector system as recited in claim 18, wherein an outlet end of each of said bores is tapped with female threading.

20. A fluid injector system as recited in claim 19 further comprising at least two injector tips adapted to threadingly engage each of said tapped outlet ends of each of said bores.

* * * * *